US006071083A

United States Patent [19]

Kakovitch

[11] Patent Number: 6,071,083

[45] Date of Patent: Jun. 6, 2000

[54] GAS FLOW DIRECTOR

[76] Inventor: Thomas Kakovitch, 2720 Fox Mill Rd., Herndon, Va. 22071

[21] Appl. No.: 09/007,108

[22] Filed: Jan. 14, 1998

[51] Int. Cl.[7] ..... F04B 23/08

[52] U.S. Cl. ..... 417/84; 417/87; 417/171; 417/194

[58] Field of Search ..... 417/84, 87, 151, 417/171, 174, 194, 198; 60/262, 265, 266; 239/127.3, 265.17

[56] References Cited

U.S. PATENT DOCUMENTS

| | | | |
|---|---|---|---|
| 2,612,750 | 10/1952 | Goddard | 60/265 |
| 3,981,143 | 9/1976 | Ross et al. | 60/266 |
| 5,269,132 | 12/1993 | Loucks | 239/127.3 |

FOREIGN PATENT DOCUMENTS

| | | | |
|---|---|---|---|
| 947141 | 6/1949 | France | 417/194 |
| 2189843 | 11/1987 | United Kingdom | 417/151 |

*Primary Examiner*—Charles G. Freay
*Assistant Examiner*—Cheryl J. Tyler
*Attorney, Agent, or Firm*—Dennison, Scheiner, Schultz & Wakeman

[57] ABSTRACT

A gas flow director for exhausting gases from chambers, and useful in the operation of operation of gas turbines, jet engines and rockets, as well as vacuum pumps and gas compressors. The gas flow director includes 1) an outer truncated cone including a closed larger end wall, a generally open smaller end comprising a gas outlet, and a solid truncated wall, 2) a gas inlet generally centrally located in the larger end, and 3) an inner truncated cone disposed within the outer truncated cone and corresponding generally in shape to the outer truncated cone, and including end and side walls generally parallel to the end and side walls, respectively, of the outer truncated cone to define a space therebetween. The end and side walls of the inner truncated cone are perforated to permit gas flow therethrough. The gas flow director also includes 4) a plurality of secondary gas inlets disposed in the side wall of the outer truncated cone, adjacent the end wall, or in the larger end wall adjacent the side wall.

10 Claims, 5 Drawing Sheets

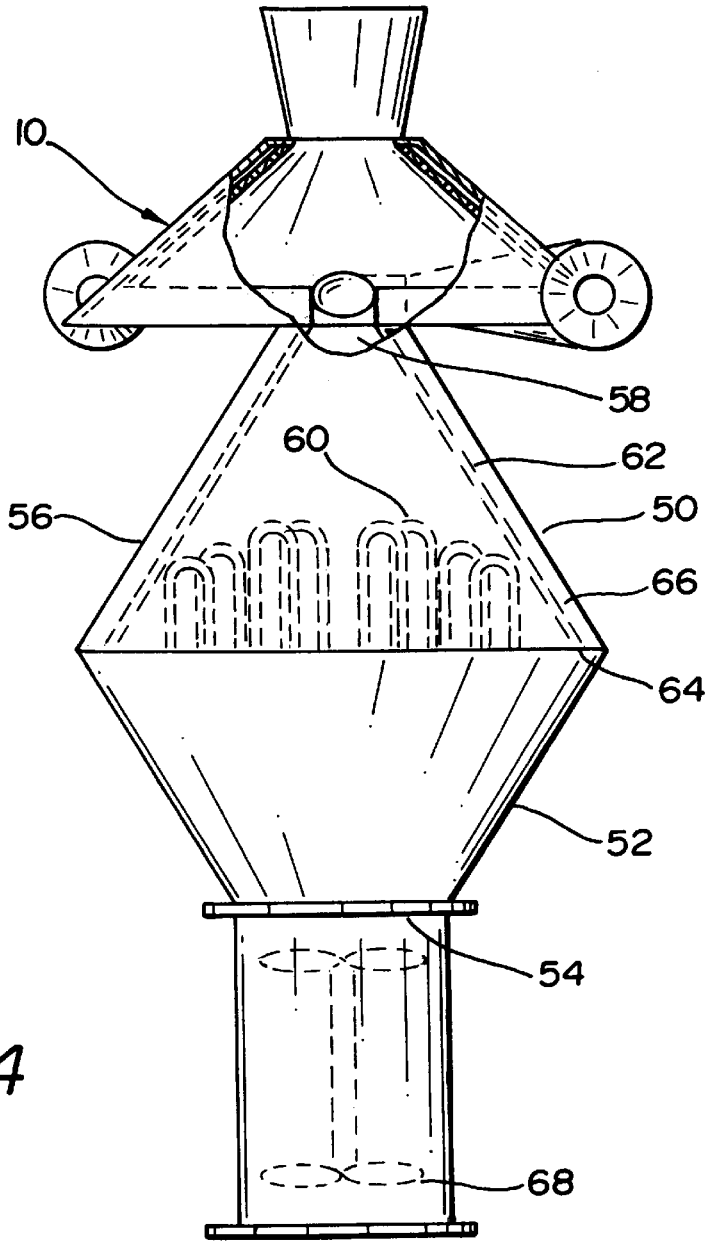
FIG. 4
FIG. 3
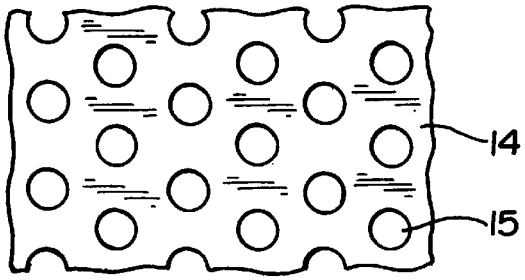

GAS FLOW DIRECTOR

BACKGROUND OF THE INVENTION

The invention relates to the field of evacuating gases from chambers to produce reduced pressures therein, and in particular to improvements in the operation of gas turbines, jet engines and rockets, as well as vacuum pumps and gas compressors.

In order to reduce the pressure in a chamber, it is well known to use a fan, compressor or other type of gas movement device to blow the gas in the chamber outwardly. The efficiency of such a device lasts only so long as there is gas in the chamber to be evacuated, since the gas assists in turning the fan blades, and reduces the amount of electrical power which must be used to operate the fan. When the pressure in the chamber has been reduced, there is less gas being moved to turn the fan blades, so more electrical power must be applied to the fan to move the blades. The reduction in efficiency at reduced pressures is considerable, and requires the use of a fan sized to be effective at reduced pressure.

Applicant has experienced the difficulties resulting from evacuating a chamber as the pressure is reduced in conjunction with operation of the power generation system disclosed in U.S. Pat. No. 5,444,981, incorporated herein by reference. In the closed system disclosed in that patent, a light, non-condensable gas, typically helium, is added to a working fluid, typically water, in a boiler. The working fluid is vaporized in the boiler, and the mixture of light gas and vaporized working fluid is used to operate a turbine to generate electric power. The light gas and working fluid mixture is then passed to a condenser to separate the working fluid from the light non-condensable gas, and the gas and working fluid are separately returned to the boiler.

As part of the cycle disclosed in that patent, a portion of the light gas may be returned to the boiler by way of aspiration by the working fluid or may be returned separately. Additionally, a compressor may be used to return the light gas to the boiler at high pressure.

In seeking to improve the process disclosed in the patent, applicant has used a fan to evacuate the light gas from the condenser, and pass it on to a compressor. However, applicant has noted the decrease in efficiency of the fan as pressure is reduced in the condenser, and a larger, more powerful fan must be used to maintain proper flow of light gas to the compressor.

Applicant's U.S. application No. 08/829,940 filed Apr. 1, 1997, now U.S. Pat. No. 5,810,564 proposes a solution to the problem of evacuating light gases with an apparatus comprising a housing having a lower, downwardly facing wall and an upper, upwardly facing wall, an inlet disposed within the lower wall and comprising a first gas flow director of truncated conical shape having a larger open end facing downwardly and a smaller open end facing upwardly, in flow communication with the housing. A plurality of stationary vanes is disposed at the smaller open end of the first gas flow director, for imparting a vortex flow to gas flowing therethrough.

An outlet is disposed within the upper wall of the housing comprising a second gas flow director of truncated conical shape and having a larger end facing downwardly and disposed within the housing and a smaller open end facing upwardly, external to the housing, the second gas flow director further comprising a circumferential surface portion disposed within the housing. The surface portion comprises outer and inner surfaces, and a means for closing the larger end of said second gas flow director, to prevent flow of gas therethrough. A plurality of slits is disposed longitudinally in this surface portion of the second gas flow director, each slit comprising a guide flap disposed on the outer surface and a guide flap disposed on the inner surface for guiding gas flow through the slit.

A heating device is disposed within the second gas flow director and a deflector is disposed within the housing adjacent the means for closing to direct gas flow away from the means for closing and towards the outer surface of the circumferential surface portion.

In the method for using this apparatus, the gas in the outlet is heated by the heating device to a temperature at least about 16° C. above ambient to increase gas flow through the device.

SUMMARY OF THE INVENTION

It is therefore an object of the invention to provide an improved gas flow director for evacuating chambers.

It is a further object of the invention to more generally improve gas flow, particularly from turbines, with a gas flow director.

It is another object of the invention to improve the process disclosed in U.S. Pat. No. 5,444,981 by more efficiently returning the light gas to the boiler.

These and other objects of the invention are achieved with an apparatus referred to hereinafter as a gas flow director, a non-adiabatic, steady-state gas moving device, utilizing a truncated cone, which moves gas by creating vortex flow.

The apparatus of the invention thus comprises an outer truncated cone having a larger end, a smaller end and a truncated side wall, with the larger end generally closed by an end wall having a gas inlet centrally located therein, and the smaller end being generally open and having a gas outlet therein. Within the outer truncated cone is a corresponding inner truncated cone having end and side walls generally parallel to the end and side walls of the outer truncated cone, with a gas inlet in the inner cone corresponding to the gas inlet in the outer cone. With the relative positioning of the inner and outer cones, a space is defined therebetween. The end and side walls of the inner truncated cone are perforated to permit gas flow therethrough.

A plurality of secondary gas inlets open to the ambient or other defined atmosphere are placed in the side wall or the larger end wall of the outer cone. These gas inlets may themselves be in the form of truncated cones, with the smaller ends of these cones passing into the side wall of the outer cone.

Surprisingly, it has been found that gas passing into the gas inlet passes directly to the gas outlet without escaping through the secondary gas inlets, and that the efficiency of gas movement is greatly increased. Advantageously, a fan is used to pass gas to the gas inlet, with the efficiency of the fan being greatly increased by use in conjunction with the gas flow director of the invention.

In a further embodiment of the invention, the apparatus as used for evacuating a gas may be placed in a container to eliminate the problems associated with leakage of light gases. Further improvement can be obtained by placing a second stage apparatus in series with the first stage.

The gas flow director of the invention can advantageously be used to increase the efficiency of gas turbines, jet engines and rockets. The efficiency of gas turbines is improved by reducing back pressure, while the efficiency of jet engines and rockets is improved by inducing increased mass flow, and therefore increasing thrust.

BRIEF DESCRIPTION OF THE DRAWINGS

FIG. 3 is a plan view of a perforated material used for the inner cone of FIG. 1;

FIG. 4 is a longitudinal cross sectional view of an apparatus according to U.S. application No. 08/829,940, now U.S. Pat. No. 5,810,564, utilizing the apparatus according to the invention;

DESCRIPTION OF THE PREFERRED EMBODIMENTS

Figure 1:
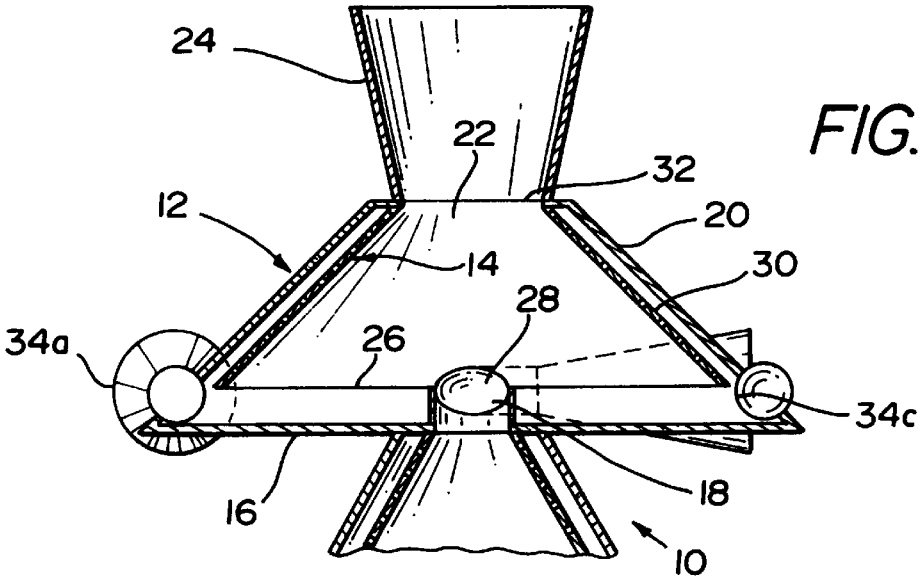
FIG. 1 is a longitudinal cross-sectional view of a gas flow director according to the invention.

Shown in FIG. 1 is a gas flow director 10 according to the invention including an outer truncated cone 12 and an inner truncated cone 14. Outer truncated cone 12 includes an end wall 16 with a central gas inlet 18 at its larger end, a side wall 20 and a gas outlet 22 at its open smaller end. A connector 24 is provided at the gas outlet.

Inner truncated cone 14 includes a perforated end wall 26 with a gas inlet 28 aligned with gas inlet 18, a perforated side wall 30 and an open gas outlet 32 aligned with gas outlet 22.

The outer cone has an inner diameter of 49" at the large end and a height of 18". The smaller cone has an inner diameter of 45" and a height of 15", leaving a space of 3" between the end wall and 2" between the side walls. Both cones taper to a smaller end of 9" diameter. The gas inlet for both cones is 5.4" in diameter located in the center of each cone.

Figure 2:
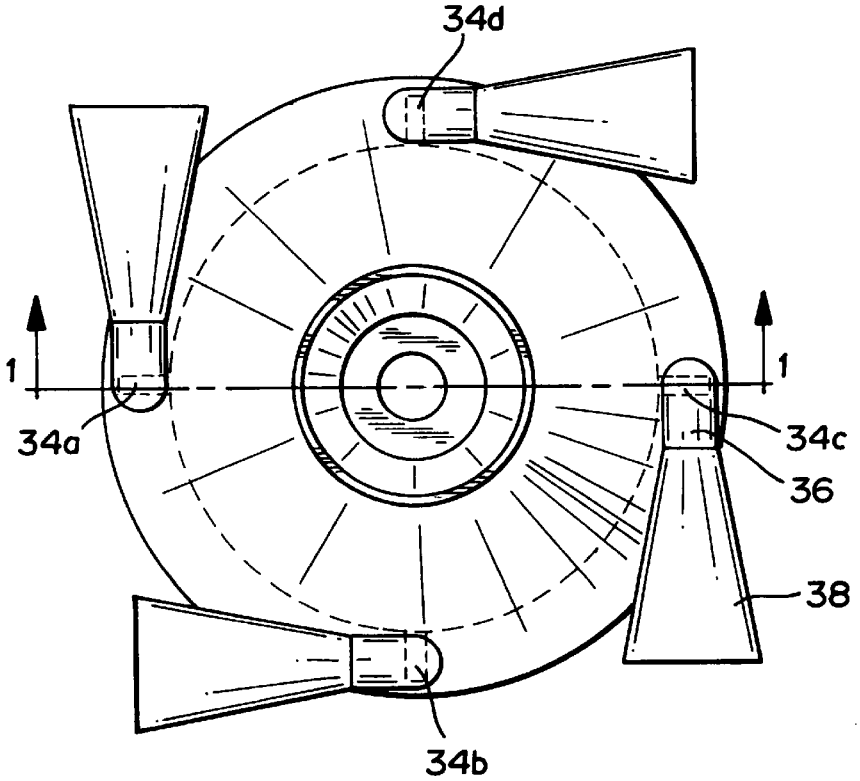
FIG. 2 is a top plan view of the gas flow director shown in FIG. 1.

The secondary gas inlets are disposed in the space between the outer and inner cones, at the junction of the side and end wall, and are best viewed in FIG. 2. Four secondary inlets 34*a*–34*d* are disposed at 90° with respect to each other, with each inlet comprising a connector 36 passing through the outer cone and an air guide 38 of truncated conical shape at the end of each connector 36.

Figure 1A:
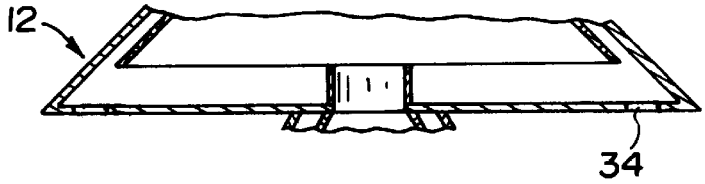
FIG. 1*a* is a partial schematic cross-sectional view of a variation of the gas flow director shown in FIG. 1.

In a variation of the embodiment of FIG. 1 which is shown in FIG. 1*a*, secondary gas inlets 34 are provided in the end wall of the outer cone, rather than the side wall.

FIG. 3 shows a perforated metal sheet used for the inner cone. The sheet is designated 3/16" staggered, with each hole 15 having a diameter of 0.1875", 12 holes per square inch. 33% of the sheet is open for passage of gas.

The particular perforated sheet shown is typical of commercially available materials useful for the invention, but is not critical. Other configurations, hole sizes and open areas may be used, depending on the gas flow necessary.

FIG. 4 shows an improvement to the device disclosed in U.S. application No. 08/829,940, now U.S. Pat. No. 5,810,564, incorporating the improvement of the invention. Thus, FIG. 4 shows a vortex pump 50 including a lower truncated conical portion 52 with a gas inlet 54 and an upper truncated conical portion 56 with a gas outlet 58. Upper conical portion 56 includes an electric heating means 60.

In upper conical portion 56 there is now an inner perforated truncated cone 62 including end wall 64 and side wall 66. In the lower conical portion 52 the entrance vanes have been replaced with a fan 68 connected to a condenser for removal of helium. Use of the perforated inner truncated cone results in an insulating gas flow along the inner wall of the outer cone 56, and as a result, the outer wall of the outer cone 56 is relatively cool.

The gas outlet of upper conical portion 56 is connected to an inlet of a gas flow 10 director according to the invention.

Figure 5:
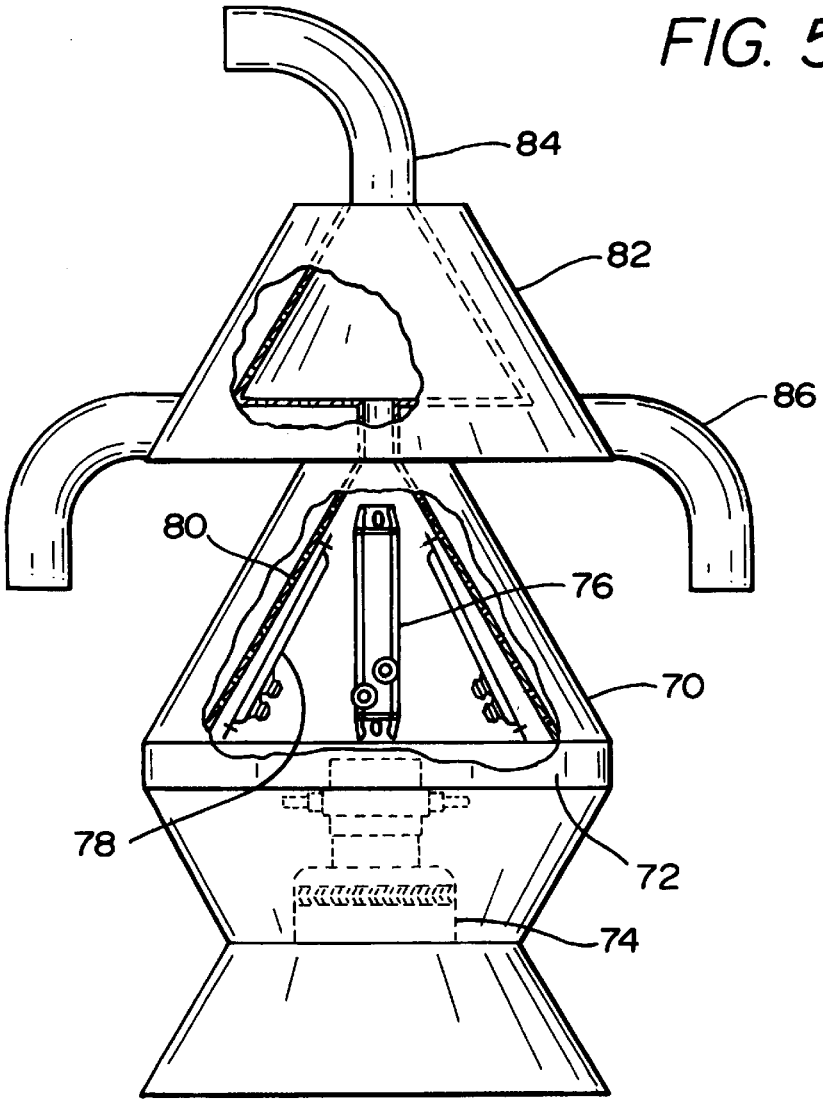
FIG. 5 is a longitudinal cross-sectional view of a first embodiment of a two-stage gas flow director.

FIG. 5 shows a modification of the vortex pump-gas flow director system of FIG. 4, which is used in conjunction with a commercial heating system for a building. The vortex pump portion 70 has an inlet 72 connected to a helium condenser. Fan 74 is used to blow helium from the condenser to the vortex pump, which includes a central tubular guide 76, strip heaters 78 and inner perforated cone 80. Gas flow director 82 is substantially as described hereinabove, but outlet 84 and gas inlets 86 are formed of extended lengths of pipe.

Figure 6:
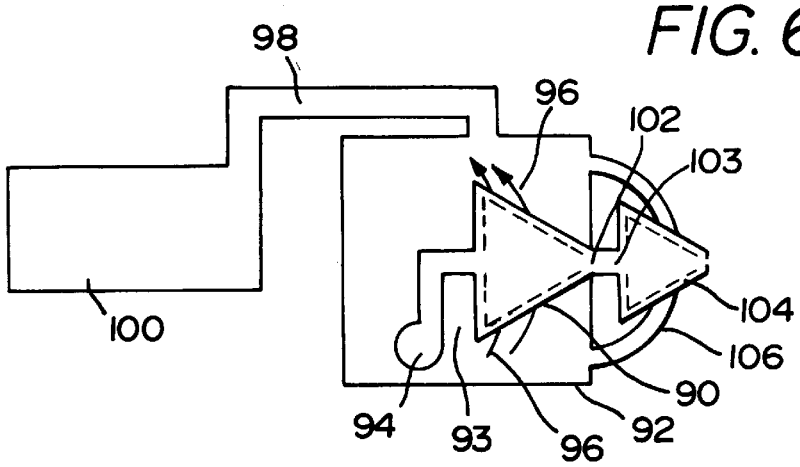
FIG. 6 is a longitudinal cross-sectional view of a second embodiment of a two-stage gas flow director.

FIG. 6 shows a two-stage embodiment used for evacuating a light gas. The first stage gas flow director 90 is disposed in a closed container 92, and receives light gas through inlet 93 from pump 94. Gas flow director 90 has four secondary inlets 96 located in the sides thereof. Container 92 is connected by line 98 to condenser 100. Outlet 102 of gas flow director 90 is connected to the inlet 103 of a second stage gas flow director 104, located outside of container 92, but having four secondary inlets 106 connected to container 92.

Figure 7:
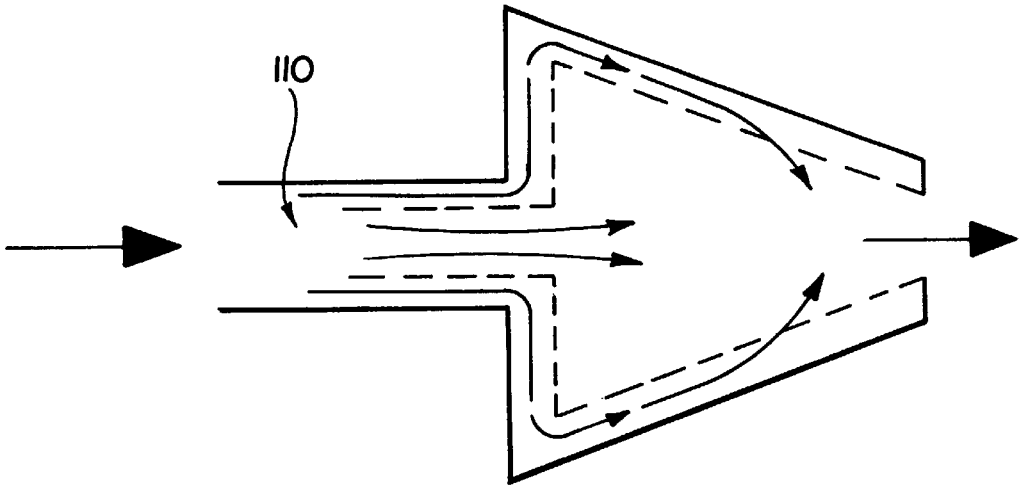
FIG. 7 is a schematic diagram of a gas flow director used in conjunction with a gas turbine.
Figure 8:
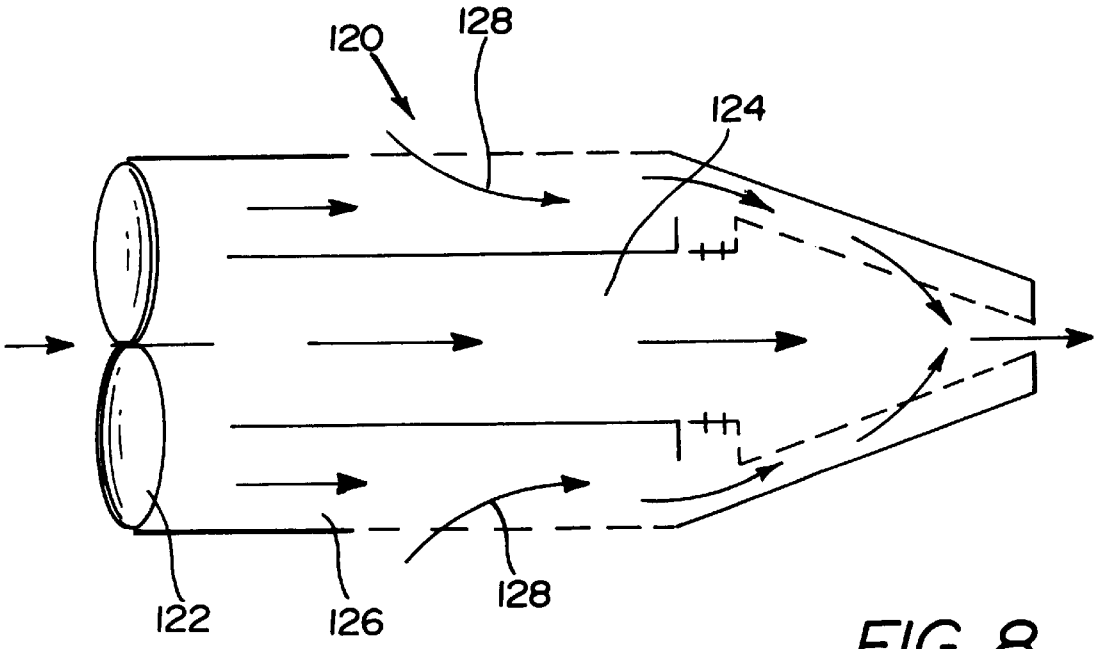
FIG. 8 is a schematic diagram of a gas flow director used in conjunction with a jet engine.
Figure 9:
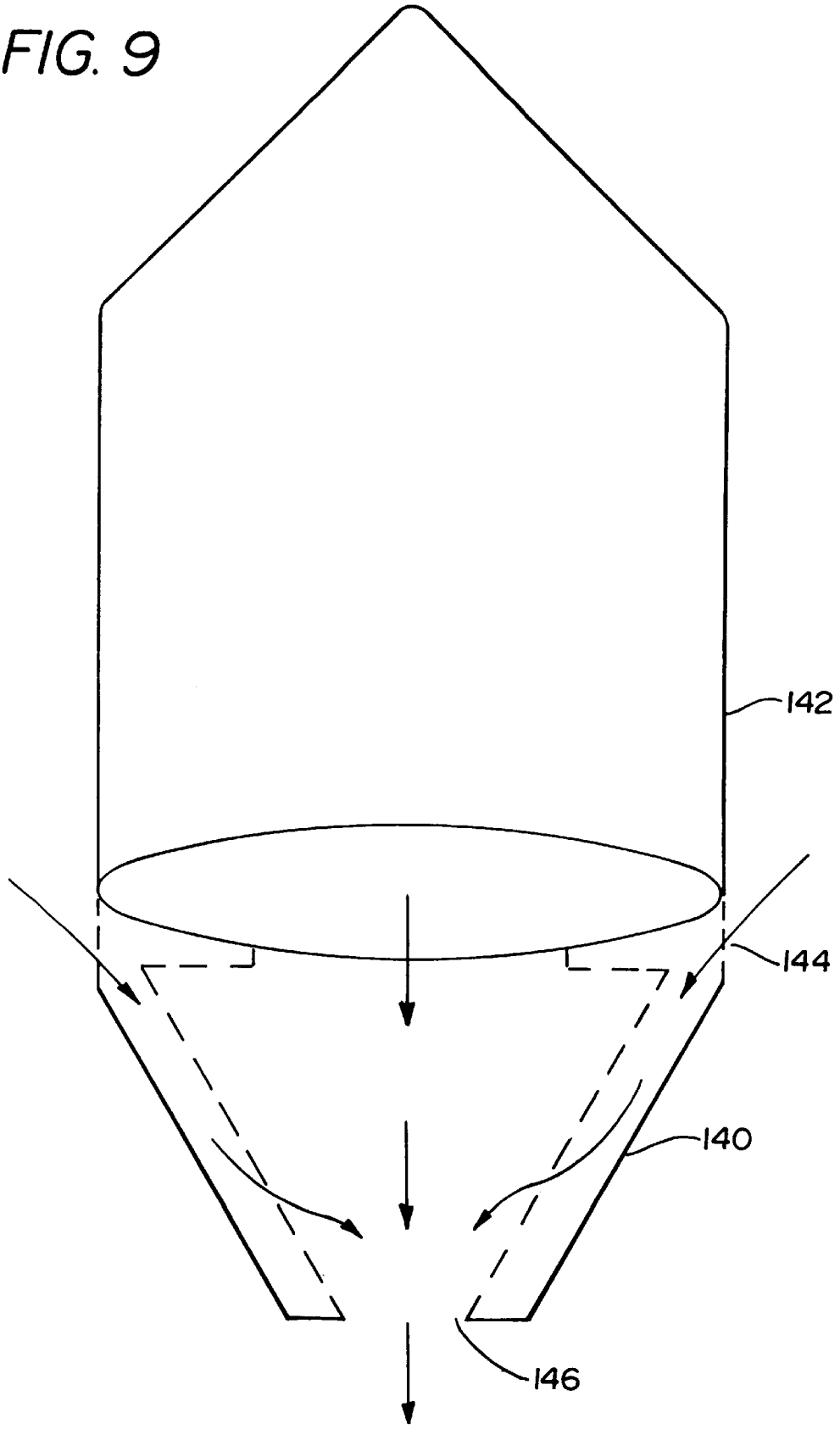
FIG. 9 is a schematic diagram of a gas flow director used in conjunction with a rocket.

FIGS. 7–9 show schematically the placement of and advantage of placing the gas flow director with a gas turbine, a jet engine and a rocket.

In FIG. 7, the gas flow director 110 is placed at the exhaust of a gas turbine, where it reduces pressure and increases efficiency.

In FIG. 8, the gas flow director 120 is placed at the exhaust of a jet engine, downstream of the turbo fan 122. Gas is directed to the gas flow director through concentric channels 124 and 126, with ambient air induction through ports 128 in outer channel 126.

In FIG. 9, the gas flow director 140 is placed at the output of a rocket engine 142. Ambient air is inducted through ports 144. By inducing ambient air into the exhaust, the differential between internal and exit temperature, pressure and volume is increased, increasing mass flow in the exit region 146 of the engine.

EXAMPLES

Gas flow directors are constructed for evacuation of helium and air, respectively. The design parameters and operational characteristics are set forth below.

| | Helium | Air |
|---|---|---|
| DESIGN PARAMETER | | |
| Diameter (ft) | 0.833 | 3.178 |
| Height of Frustum L (ft) | 0.333 | 1.54 |

-continued

| | Helium | Air |
|---|---|---|
| Check Height S − SS + WW (ft) | 0.333 | 1.54 |
| Length of Cone Side LL (ft) | 0.589 | 2.25 |
| Actual Cone Side TL (ft) | 0.471 | 1.71 |
| Heat Funnel Height (ft) | 0.333 | 1.214 |
| Heat Funnel Volume ($ft^3$) | 0.0171 | 1.404 |
| OPERATIONAL PARAMETER | | |
| Vortex Velocity (ft/sec) | 1756.28 | 1241.16 |
| $V_{dyn}$ (ft/sec) | 1756.28 | 1241.16 |
| $V_{fan}$ (ft/sec) | 1756.28 | 1241.16 |
| Power Generated by Votex (VortexHP) | 25.71 | 108.62 |
| Sonic Velocity of Gas (ft/sec) | 4210.39 | 1739.81 |
| Expected Gas Flow (CFM) | 274 | 3600 |
| Mass Flow of Evacuation (CFM) | 167.717 | 2244.69 |
| Theoretical Power for Evacuation (HP) | 5.29 | 152 |
| Gas Density in Frustum ($lbm/ft^3$) | 0.0099 | 0.0104 |

What is claimed is:

1. A gas flow director comprising:

an outer truncated cone comprising a generally closed larger end wall, a generally open smaller end comprising a gas outlet, and a generally solid truncated side wall;

a gas inlet generally centrally located in the larger end wall of the outer truncated cone;

an inner truncated cone disposed within the outer truncated cone and corresponding generally in shape to the outer truncated cone, and comprising larger end and side walls generally parallel to the larger end and side walls, respectively, of the outer truncated cone to define a space between the larger end and side walls of the outer truncated cone and the larger end and side walls of the inner truncated cone,;

the inner truncated cone comprising a gas inlet in the larger end thereof aligned with the gas inlet in the larger end of the outer truncated cone, and a smaller end comprising a gas outlet aligned with the gas outlet of the outer truncated cone, defining a gas flow passage between the gas inlet and the gas outlet of the inner truncated cone, the inner truncated cone further comprising a plurality of perforations therethrough extending between the space and the gas flow passage, and a plurality of secondary gas inlets disposed in the side wall of the outer truncated cone, adjacent the end wall, or in the larger end wall adjacent the side wall or the gas inlet.

2. Gas flow director according to claim 1, wherein the secondary gas inlets are disposed in the side wall of the outer truncated cone.

3. Gas flow director according to claim 2, wherein the secondary gas inlets have a truncated conical shape with a smaller end connected to the side wall of the outer truncated cone, the secondary inlets being disposed to provide gas flow therethrough in a direction generally tangential to the side wall of the outer truncated cone.

4. Gas flow director according to claim 1, wherein the secondary gas inlets are disposed in the larger end wall.

5. Gas flow director according to claim 4, wherein the secondary gas inlets are disposed to induce a flow of gas from the inlet between the outer truncated cone and the inner truncated cone.

6. Gas flow director according to claim 1, additionally comprising a second gas flow director having an inlet in flow the connection with said gas outlet.

7. Gas flow director according to claim 1, additionally comprising a closed container in which the gas flow director is disposed, the gas inlet being adapted for connection to a source of gas, the gas outlet being external to the container, and the secondary gas inlets being disposed inside the container, the container being adapted for connection to a condenser to provide a source of gas for the secondary gas inlets.

8. A method for improving exhausting of gas from a chamber through an exit, comprising disposing at the exit a gas flow director comprising an outer truncated cone comprising a closed larger end wall, a generally open smaller end comprising a gas outlet, and a generally solid truncated side wall;

a gas inlet generally centrally located in the larger end wall of the outer truncated cone;

an inner truncated cone disposed within the outer truncated cone and corresponding generally in shape to the outer truncated cone, and comprising larger end and side walls generally parallel to the larger end and side walls, respectively, of the outer truncated cone to define a space between the larger end and side walls of the outer truncated cone and the larger end and side walls of the inner truncated cone,;

the inner truncated cone comprising a gas inlet in the larger end thereof aligned with the gas inlet in the larger end of the outer truncated cone, and a smaller end comprising a gas outlet aligned with the gas outlet of the outer truncated cone, defining a gas flow passage between the gas inlet and the gas outlet of the inner truncated cone;

the inner truncated cone further comprising a plurality of perforations therethrough extending between the space and the gas flow passage; and a plurality of secondary gas inlets disposed in the side wall of the outer truncated cone, adjacent the end wall, or in the larger end wall adjacent the side wall or the gas inlet.

9. A method according to claim 8, wherein ambient atmosphere is induced to flow into a space defined between the outer and inner truncated cones, through the perforations in the inner truncated cone and out through the gas outlet.

10. A method according to claim 8, wherein gas from the exit is induced to flow into a space defined between the outer and inner truncated cones, through the perforations in the inner truncated cone and out through the gas outlet.

* * * * *